US006986686B2

(12) United States Patent
Shibata et al.

(10) Patent No.: US 6,986,686 B2
(45) Date of Patent: Jan. 17, 2006

(54) ELECTRICAL PLUG FOR SUPPLYING ELECTRIC POWER FROM A POWER SUPPLY TO A MEDICAL INSTRUMENT

(75) Inventors: Norikiyo Shibata, Hachioji (JP); Shinya Masuda, Hachioji (JP); Hitoshi Karasawa, Hachioji (JP); Manabu Ishikawa, Akiruno (JP)

(73) Assignee: Olympus Corporation (JP)

( * ) Notice: Subject to any disclaimer, the term of this patent is extended or adjusted under 35 U.S.C. 154(b) by 439 days.

(21) Appl. No.: 10/082,619

(22) Filed: Feb. 21, 2002

(65) Prior Publication Data

US 2002/0177373 A1 Nov. 28, 2002

(30) Foreign Application Priority Data

Feb. 23, 2001 (JP) ..... 2001-048584

(51) Int. Cl.

| | |
|---|---|
| ***H01R 25/00*** | (2006.01) |
| ***H01R 27/02*** | (2006.01) |
| ***H01R 31/00*** | (2006.01) |
| ***H01R 33/88*** | (2006.01) |
| ***H01R 33/90*** | (2006.01) |
| ***H01R 33/92*** | (2006.01) |
| ***H01R 33/94*** | (2006.01) |
| ***H01R 3/00*** | (2006.01) |
| ***H01R 13/627*** | (2006.01) |

(52) U.S. Cl. ..... 439/650; 439/488; 439/352

(58) Field of Classification Search ..... 439/651, 439/655, 650, 653, 488, 276, 351, 352; 433/119; 606/31

See application file for complete search history.

(56) References Cited

U.S. PATENT DOCUMENTS

| | | | | | |
|---|---|---|---|---|---|
| 3,725,840 | A | * | 4/1973 | Hesse | 439/335 |
| 4,960,393 | A | * | 10/1990 | Stoll et al. | 439/651 |
| 5,301,061 | A | * | 4/1994 | Nakada et al. | 359/362 |
| 5,324,297 | A | * | 6/1994 | Hood et al. | 606/99 |
| 5,395,240 | A | | 3/1995 | Paschke et al. | 433/119 |
| 5,660,567 | A | * | 8/1997 | Nierlich et al. | 439/620 |
| 5,807,392 | A | | 9/1998 | Eggers | 606/31 |
| 6,010,369 | A | * | 1/2000 | Itabashi et al. | 439/660 |
| 6,022,237 | A | * | 2/2000 | Esh | 439/348 |
| 6,083,030 | A | * | 7/2000 | Wright | 439/352 |
| 6,402,553 | B1 | * | 6/2002 | Schwarz et al. | 439/607 |

* cited by examiner

*Primary Examiner*—Chandrika Prasad
(74) *Attorney, Agent, or Firm*—Ostrolenk, Faber, Gerb & Soffen, LLP

(57) ABSTRACT

A connector for medical instruments has an elongated plate-like electrode provided in a socket connected to a plug of the medical instrument and extending in a moving operation direction in which the socket is connected to the medical instrument and an elongated plate-like electrode provided in the plug and extending in a moving operation direction in which the socket is connected. The connector further has an annular wall provided in the plug to surround the electrode of the plug.

37 Claims, 12 Drawing Sheets

ELECTRICAL PLUG FOR SUPPLYING ELECTRIC POWER FROM A POWER SUPPLY TO A MEDICAL INSTRUMENT

CROSS-REFERENCE TO RELATED APPLICATION

This application is based upon and claims the benefit of priority from the prior Japanese Patent Application No. 2001-048584, filed Feb. 23, 2001 the entire contents of which are incorporated herein by reference.

BACKGROUND OF THE INVENTION

The present invention relates to a connector for medical instruments which feeds electrical power from a power supply to the medical instrument with the use of a socket and plug.

An ultrasound treating instrument for performing a surgical operation with the use of ultrasound has been known. The ultrasound treating instrument includes a handpiece having a transducer and transmits an ultrasonic vibration which is generated in the transducer to a probe coupled to the handpiece and performs a treating operation with a forward end of the probe set in contact with a living body. A socket of an electric power feeding cable is connected to a plug of the handpiece and, through the cable, the electric power from the power supply is fed to the transducer in the handpiece.

When the handpiece is used, an electric power feeding cable for transmitting a drive current is previously connected to a respective individual handpiece. The probes, if differing in types, etc., act differently upon the living tissue. The probes are different in types and kinds and selectively used in accordance with the use to which they are put. The exchange of the probes to be attached to the associated handpieces takes a lot of time and labor since they are of a detachable screw-threaded type. Such an operation is not convenient during a surgical operation. The exchange of probes has to be done quickly in accordance with the situation under which the surgical operation proceeds. It is, therefore, convenient to make exchanges for handpiece units each with an initially prepared probe attached thereto instead of effecting the exchange for probes each time.

In the case where the exchange of initially prepared handpiece units is done instead of the exchange of probes each time, the associated handpiece has to be replaced by another handpiece together with a cable connected thereto.

In this case, since such handpieces have to be initially prepared with their own special cable connected thereto, the same number of cables are needed and the situations around the instruments are messy such as the entangling of cables. Further, it is necessary to select the needed cable and re-connect it to a power supply. It is cumbersome to re-connect the selected cable to the power supply.

It may be considered that a common cable is used for associated handpieces. In this case, those electric contacts of a plug section of the handpiece and those electric contacts of a socket section of the cable side are exposed to the exterior.

Normally, the respective electric contact sections are exposed to the exterior and they are inadvertently touched by the user. If this is the case, then the contact surface of the electric contact section becomes soiled and there is a risk that the electric conduction performance will be lowered.

In order to prevent a lowing in the electric conduction performance of the electric contacts, one contact is formed of a male type pin and the other contact is formed of a female type narrow hole. By doing so, these contacts are fitted together to create an electric connection. The treating instrument of U.S. Pat. No. 5,395,240 is shown as a pin/hole fitting type. For this reason, the cleanability of the contact section is not good.

The ultrasound treating instrument used for surgery is oftened soiled with humor and blood deposited on its contact section. If this soiled state is left as it is, the electric conduction performance of the electric contact is lowered. For this reason, it is necessary to deeply clean the contact section.

In the pin/hole connection type, however, if the connection section surface is soiled with blood, etc., the cleanability of it is not good. In order to enhance such cleanability, it is possible to use a structure with the connection section area opened. In such an open structure, the opening section of the connector becomes greater and the electric connection section is liable to be touched by human fingers. If the contacts are inadvertently touched by a finger, etc., and a shorting occurs between the contacts, then a discharge sometimes occurs due to a charge built up in the transducer inside the handpiece under a temperature variation involved. Further, due to the greater opening section of the connector, there is also a risk that the contact section will be soiled again with a foreign substance deposited thereon. If, for example, the open structure of the U.S. Pat. No. 5,807,392 is applied to an ultrasonic handpiece, the area between the pin contacts is liable to be touched by a finger and a discharge unavoidably occurs due to the presence of a charge involved.

BRIEF SUMMARY OF THE INVENTION

A connector for a medical instrument according to the present invention comprises a medical instrument adapted to be rendered active upon receipt of electric power from a power supply to allow a treating operation to be performed on a subject; a socket connected to the medical instrument and having a first electrode to allow the electric power to be supplied to the medical instrument; and a plug provided on the medical instrument and adapted to engage the socket to allow the electric power from the power supply to the medical instrument, wherein the plug includes a second electrode having an exposed contact portion electrically connected to the first electrode to allow the medical instrument to be rendered active, at least the exposed contact portion of the second electrode being so located as an elongated portion as to extend along a moving direction in which the plug is connected to the socket, and an annular wall so provided as to surround at least the exposed contact portion of the second electrode.

A connector for medical instruments according to the present invention comprises a medical instrument adapted to be rendered active upon receipt of an electric power to allow a treating operation to be performed on a subject; a socket having a first electrode for supplying an electric power from a power supply to the medical instrument; and a plug provided on the medical instrument and adapted to engage the socket to allow the electric power which is fed from the power supply to be supplied to the medical instrument, wherein the plug includes a projection provided at a central area; a second electrode provided on a peripheral surface of the projection and having at least a portion exposed on the peripheral surface of the projection and electrically connectable to the first electrode to allow the medical instrument to be rendered active; and an annular wall provided to surround the peripheral surface of the projection, the annular wall and projection being spaced apart a predetermined distance from each other to define a circular groove therebetween.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION

An ultrasonic coagulation incising apparatus according to a first embodiment of the present invention will be explained below by referring to FIGS. 1 to 12.

Figure 1:
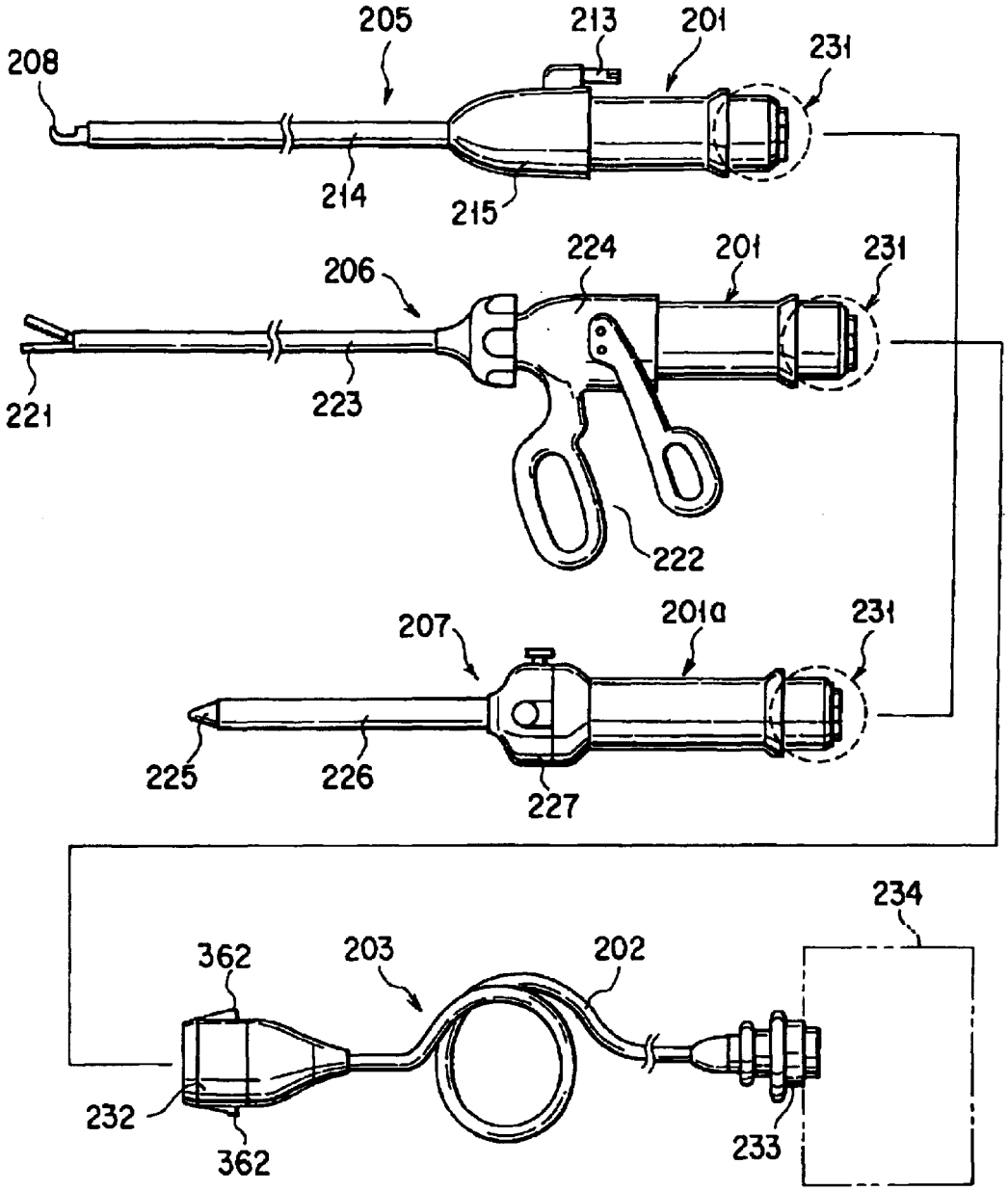
FIG. 1 is an explanatory view showing an ultrasonic coagulation incising apparatus system according to a first embodiment of the present invention.

FIG. 1 shows a system of an ultrasound treating apparatus. This system comprises a plurality of, or a plurality of kinds of, treating instruments, here, handpieces 201, 201, 201*a*, and a common detachable cable unit 203 having a socket 232 for allowing any of these to be removably attached thereto and a cable 202. It is to be noted that an ultrasonic transducer for generating ultrasound vibration is inserted into the handpieces 201, 201 and 201*a*.

Plug sections 231 of the handpieces 201, 201, 201*a* are of a commonly connectable type and can be detachably mounted in a socket 232 of the commonly detachable cable unit 203.

Here, as the handpieces, three handpieces are prepared: the handpiece 201 with a hook probe unit 205 attached thereto, the handpiece 201 with a scissors probe unit 206 attached thereto, and the handpiece 201*a* of a different kind with a trocar unit attached thereto.

The hook probe unit 205 and scissors probe unit 206 are detachable/exchangeable relative to the same handpiece 201 and commonly usable relative to one handpiece 201. The handpieces 201 and 201*a* have different ultrasonic resonant frequencies.

Figure 2:
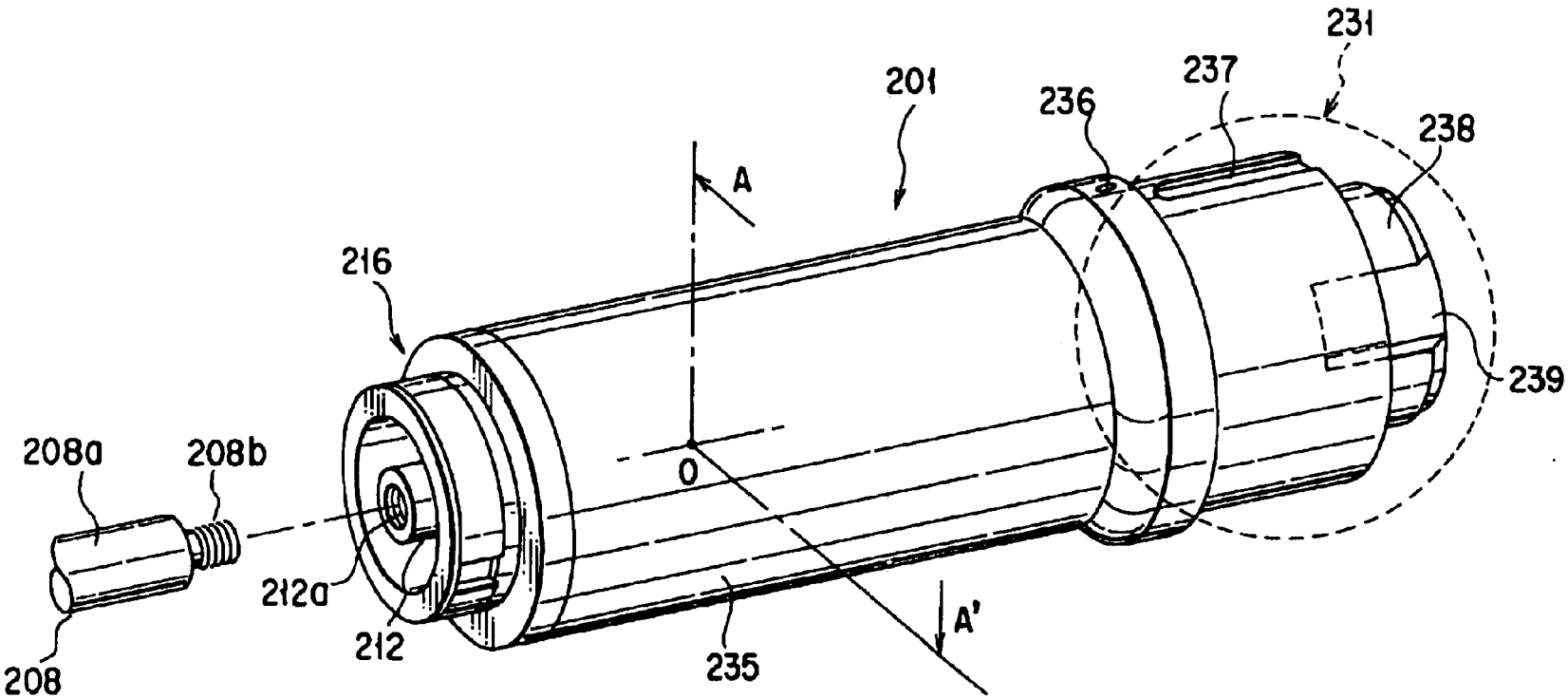
FIG. 2 is a perspective view showing a handpiece of the ultrasonic coagulation incising apparatus according to the first embodiment of the present invention.
Figure 3A:
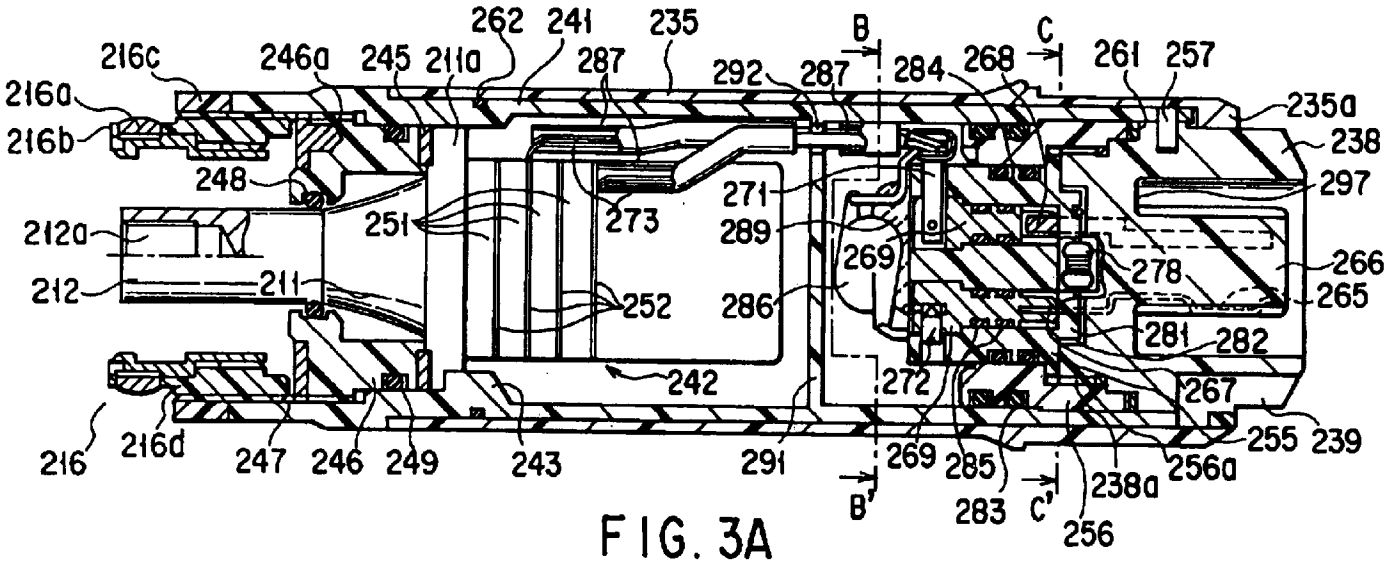
FIG. 3A is a view in longitudinal cross-section as taken along line A-0-A' in FIG. 2 showing a handpiece of the ultrasonic coagulation incising apparatus according to the first embodiment of the present invention.

The hook probe unit 205 has a hook probe 208. As shown in FIG. 2, the hook probe 208 is formed with a threaded section 208*b* on its base end portion 208*a*. The threaded section 208*b* of the probe 208 is threaded into, and connected to, a threaded section 212*a* of a probe attaching section 212 formed in the forward end portion of a later-described horn 211 of the handpiece 201. A sheath 214 is fitted over the hook probe 208. A high frequency feeding terminal 213 is provided on a base end 215 of the sheath 214. As shown in FIG. 3A, with a base end portion 215 of the sheath 214 fitted on the forward end portion of the handpiece 201, the base end portion 215 is removably attached to a sheath connection section 216 provided on the forward end of the handpiece 201.

The scissors probe unit 206 has a scissors probe 221. A threaded section is formed on the base portion of the scissors probe 221. By threading this threaded section into the threaded section 212*a* of the probe attaching section 212 formed on the forward end of the horn 211 of the handpiece 201, the scissors probe 221 is fastened to the horn 211. A sheath 223 including a handle 222 is fitted over the scissors probe 221. The base end portion 224 of the sheath 223 is removably attached to a sheath connection section 216 in such a state as to be fitted over the forward end portion of the handpiece 201.

The trocar unit 207 is different from the hook probe unit 205 and scissors probe unit 206 in terms of its ultrasonic resonant frequency. For this reason, the trocar probe 225 is attached to the handpiece 201*a* for exclusive use. The trocar probe 225, although not shown, is fastened to the threaded section formed in a horn of the handpiece 201*a* as in the case of the above-mentioned handpiece. An outer sheath tube 226 is fitted over the trocar probe 225. A base end portion 227 of the outer sheath tube 226 is removably attached to the handpiece 201*a*.

As shown in FIG. 1, the handpieces 201 and 201*a* each have a handpiece plug section 231 at their proximal side end. The respective handpiece plug sections 231 are of the same type and have the same configuration. For this reason, it is possible to removably fit a common socket over the plug section 231.

The handpiece plug section 231 is so constructed that the handpiece socket 232 provided on one side end of the cable 202 of the detachable cable unit 203 can be removably attached to the handpiece plug section 231. A generator plug 233 detachably connected to a power supply generator 234 is provided on the other end of the cable 202 of the cable unit 203. Electric power is supplied as a drive power from the power supply generator 234 through the generator plug 233 and cable 202 to a contact provided in the handpiece socket 232.

As shown in FIG. 2, the sheath connection section 216 for connection to the sheaths 214 and 223 is provided at the forward end of the handpiece 201. An outer covering member of the handpiece 201 is comprised of an outer case 235 formed with an annular wall. An indicator mark 236 is attached to a site on the upper surface of an outer periphery of the outer case 235 so as to provide a location mark upon the attachment of the handpiece socket 232 to the handpiece plug 231. The handpiece plug section 231 has a position aligning groove 237 serving as a guide when the socket is attached to the plug, a connector shell 238 formed with an annular wall and having a later-described contact in its inside, and a lock guide 239 formed on the outer periphery of the connector shell 238 to allow the insertion of a lever when the lever is used to fix the handpiece socket 232 in place.

FIG. 3A is a view in longitudinal cross-section of a portion as taken along line A-O-A' in FIG. 2. The internal structure of the handpiece 201 will be explained below by referring to FIG. 3A.

The sheath connection section 216 is so constructed as to allow the sheath (214, 223) to be attached/detached in a simpler way. That is, the sheath connection section 216 comprises a C ring 216*a* having a C-shaped configuration for securing a proper attaching/detaching amount of force, a C-ring frame 216*b* incorporated to prevent the C-ring 216*a* being dropped, a coupling screw member 216*d* fixed to an inner case 241 constituting a structure of the handpiece 201, and a screw member 216*c* which, together with the screw member 216*d*, makes an axial length adjustment.

A bolted Langevin type transducer 242 is held in the inner case 241 and converts a received drive current to an ultrasonic vibration by energy conversion. The Langevin type transducer 242 is fixed in place by abutting a flange 211*a* which is formed on the proximal side end of the horn 211 against a rib 243 formed on the inner surface of the inner case 241. A packing 245 is located in front of the flange 211*a*. By threading the fixing nut 246, that is, a threaded section 246*a* of the fixing nut 246, into a threaded section 247 formed in the inner case 241, the bolted Langevin type transducer 242 is fixed to, and is located in, the inner case 241. In a boundary area between the fixing nut 246 and the horn 211, an O-ring 248 is provided to ensure a water-tight seal between the horn 211 and the fixing nut and also prevent an axial displacement of the bolted Langevin type transducer 242. At a contact surface between the inner case 241 and the fixing nut 246, an O-ring 249 is provided to prevent the intrusion of vapor and liquid from the exterior.

The bolted Langevin type transducer 242 is of such a type that a stacked array of piezoelectric elements 251 for converting a drive electric current to an ultrasonic vibration is pressure-fixed to the rear end surface of the flange 211*a*. A terminal 252 for feeding electric power is held between corresponding piezoelectric elements 251.

Now an explanation will be made below about the inner structure of the handpiece plug section 231. The connector shell 238 is provided in the handpiece plug section 231. A case 255 for electroconductive members is provided inside of, and in contact with, the connector shell 238. A fixing nut 256 for fixing the case 255 is fixed in place by threading a threaded section 238*a* which is formed on the connector shell 238 into a threaded section 256*a* formed in the fixing nut 256.

The connector shell 238, case 255 and fixing nut 256 are assembled as one unit and inserted into the proximal end portion of the inner case 241 in an arrayed position. These are fixed in place in the inner case 241 by means of an adhesive and pin 257. The outer sheath 235 is fixed by an adhesive to the outer side of the inner case 241. In order to ensure positional alignment, a projection 235*a* is fitted in an associated slit of the connector shell 238. A packing 261 sandwiched between the connector shell 238 and fixing nut 256, as well as an O-ring 262 located at a contact area between the inner case 241 and the outer case 235, prevents the unsightly emergence of the adhesive to the exterior, upon being cured.

In the unit of the connector shell 238, case 255 and fixing nut 256, 4 contacts 265 for supplying the drive current from the handpiece socket 232 are provided, substantially concentrically on the peripheral surface of a connector projection 266 located at a central position of the connector shell 238. The contact 265 has a polarity and its forward end portion extends as a plate-like portion to provide a corresponding electrode terminal. A drive current feeding terminal 267 and drive current feeding terminal 268, as will be explained below, are press-fitted into the electroconductive members 269 and these are connected to the electroconductive members 269. The respective electroconductive members 269 are arranged in a hole in the case 255 and, as shown in FIG. 3B, a terminal 271 is inserted into the end portion of each electroconductive member 269 from the opposite side and is fixed to the corresponding electroconductive member 269 by means of a fixing screw 272. The terminal 271 is formed with a U-shaped end portion and, to this, a lead wire 273 connected to the bolted Langevin type transducer 242 is soldered and connected.

Figure 3C:
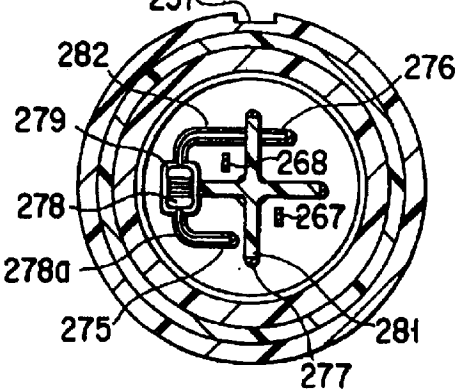
FIG. 3C is a view in transverse cross-section as taken along line C–C' in FIG. 3A.
Figure 3B:
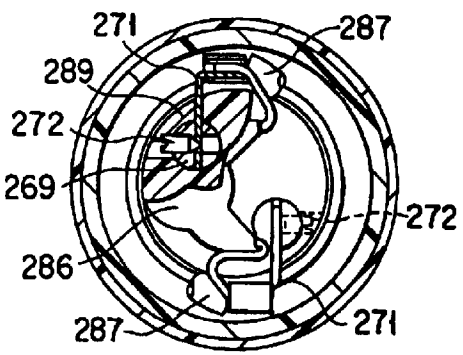
FIG. 3B is a view in transverse cross-section as taken along line B–B' in FIG. 3A.

The polarities of those contacts 265 are set to those of the drive current feeding terminals 267 and 268 for conducting the drive current shown in FIG. 3C and those of handpiece detection terminals 275 and 276 for conducting an electric current for detecting the type of handpiece 201.

As shown in FIG. 3C, a cross-like groove 277 is formed in a surface contacting with the case 255 on the connector shell 238 side and further, in that contacting surface, a groove 279 is also formed to set a resistor 278 for detecting the type of handpiece 201. After the resistor 278 has been set in the groove 279, a silicone rubber 282 is filled in that gap and, by doing so, the terminals 278*a* of the resistor 278 are fixed onto a slit in the handpiece detection terminals 275 and 276. In the cross-like groove 277, a corresponding cross-like projection 281 on the surface of the case 255 contacting with the connector shell 238 is set and a silicone rubber 282 is filled in that gap. An O-ring 283 is provided at a contacting surface between the inner case 241 and the fixing nut 256, an O-ring 284 is provided at a contacting area between the case 255 and the fixing nut 256, and, further, an O-ring 285 is provided at a contacting area between the electroconductive member 269 and the case 255. By doing so it is possible to prevent the intrusion of a vapor or liquid from these areas into an inside.

The electroconductive member 269 conducts a drive current fed from the drive current feeding terminals 267 and 268. The terminals of a capacitor 286 are soldered to the U-shaped groove of the two terminals 271. Further, these are covered with a heat shrinkable tube 287. The capacitor 286 is fixed by silicone rubber 289 to the case 255.

As shown in FIG. 3A, a partition wall 291 is formed inside the inner case 241 and a through hole 292 is formed in the partition hole 291. The lead wire 273 set out above extends through the through hole 292. By doing so, the arranging position of the lead wires 273 is restricted, thereby preventing any entangling contact between the transducer 242 and the part of the lead wires 273. For this reason, the heat shrinkable tube 287 covered around the lead wire 273 prevents the generation of frictional heat by the ultrasonic vibration as well as prevents the occurrence of short-circuiting.

Figure 4:
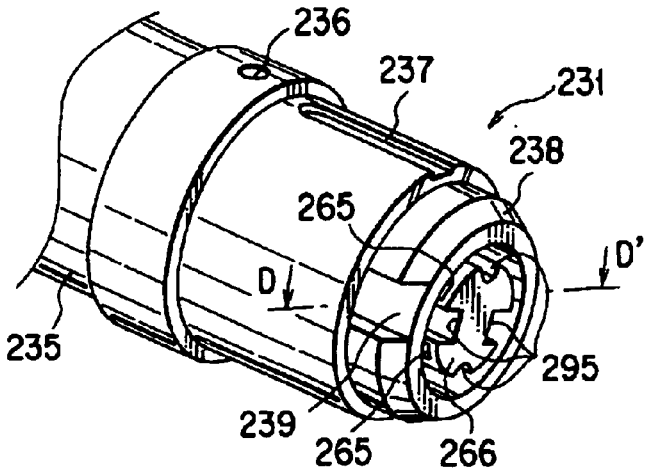
FIG. 4 is a perspective view showing a handpiece plug section of a handpiece of an ultrasonic coagulation incising apparatus according to the first embodiment of the present invention.

Next, an explanation will be made below about the handpiece plug 231 of the handpiece 201. As shown in FIG. 4, the connector shell 238 is formed with an annular wall surrounding the connector projection (projecting section) 266. The connector projection 266 is situated at a central area in the connector shell 238 and located in a concentrical fashion. Fitting slits 295 for guiding, as well as contacts 265, are provided at the outer peripheral surface of the connector projection 266. The contact 265 is formed of a narrow strip-like plate and its longitudinal direction is located along a longitudinal axis direction of the connector projection 266. That is, the electrode element formed of an electrode forming plate extends in an insertion direction in which the socket 232 is inserted over the plug 231.

Figure 5:
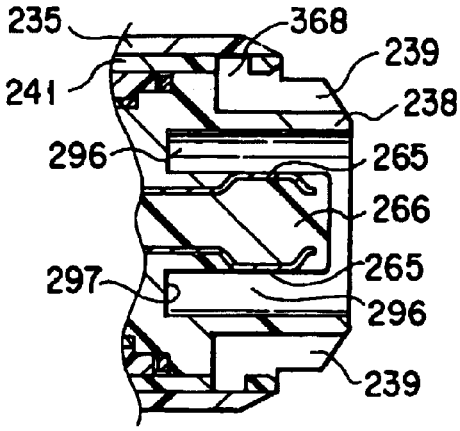
FIG. 5 is a view in longitudinal cross-section, as taken along line D–D' in FIG. 4, showing a handpiece plug section of the handpiece.

Between the connector projection 266 including the contacts 265 and the connector shell 238, a fitting space 296 is concentrically defined as a bottomed circular groove as shown in FIG. 5 and the connector projection 266 is so defined as to leave a predetermined distance (width) relative to the connector shell 238. In this case it is desirable that the width of the fitting space 296 be less than that of a finger. As shown, the height of the connector shell or the annular wall of the connector shell from the bottom of the groove is higher than that of the projection from the bottom of the groove.

The electrode elements of the contact 265 are partly exposed at the peripheral surface of the connector projection 266. The exposed portion of the electrode element is located a predetermined distance, for example, more than a width of the contact 265, away from a bottom surface 297 of a connector fitting groove constituting a circumferential groove. The exposed contact portion of the electrode element is also located deep into the circumferential groove from the forward end surface of the connector projection 266. For example, the exposed portion of the electrode element is formed down to a deep position of the circumferential groove which is spaced by more than the width of the contact 265.

Figure 6:
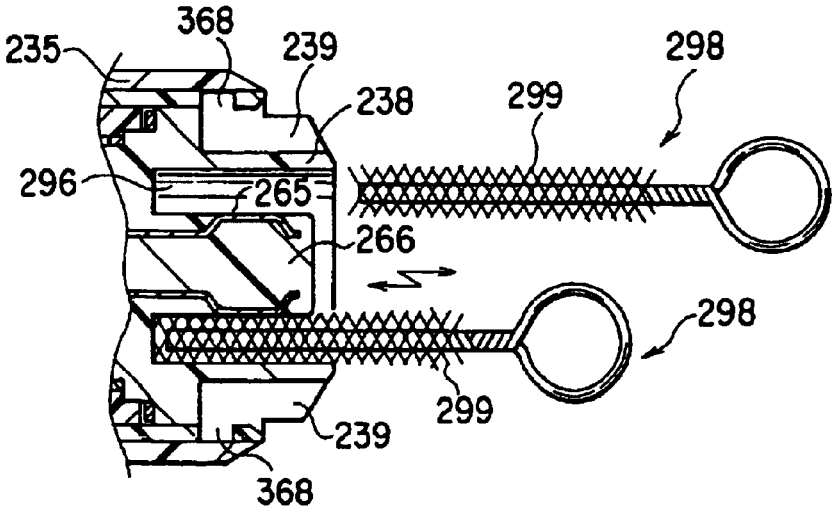
FIG. 6 is a view in longitudinal cross-section showing the cleaning of the handpiece plug section of the handpiece in the ultrasonic coagulation incising apparatus according to the first embodiment of the present invention.

The fitting space 296 is so dimensioned as not to allow a finger to be normally inserted therein. FIG. 6 shows the state in which a brush section 299 of a cleaning brush 298 is inserted into, and withdrawn out of the fitting space 296.

Figure 7:
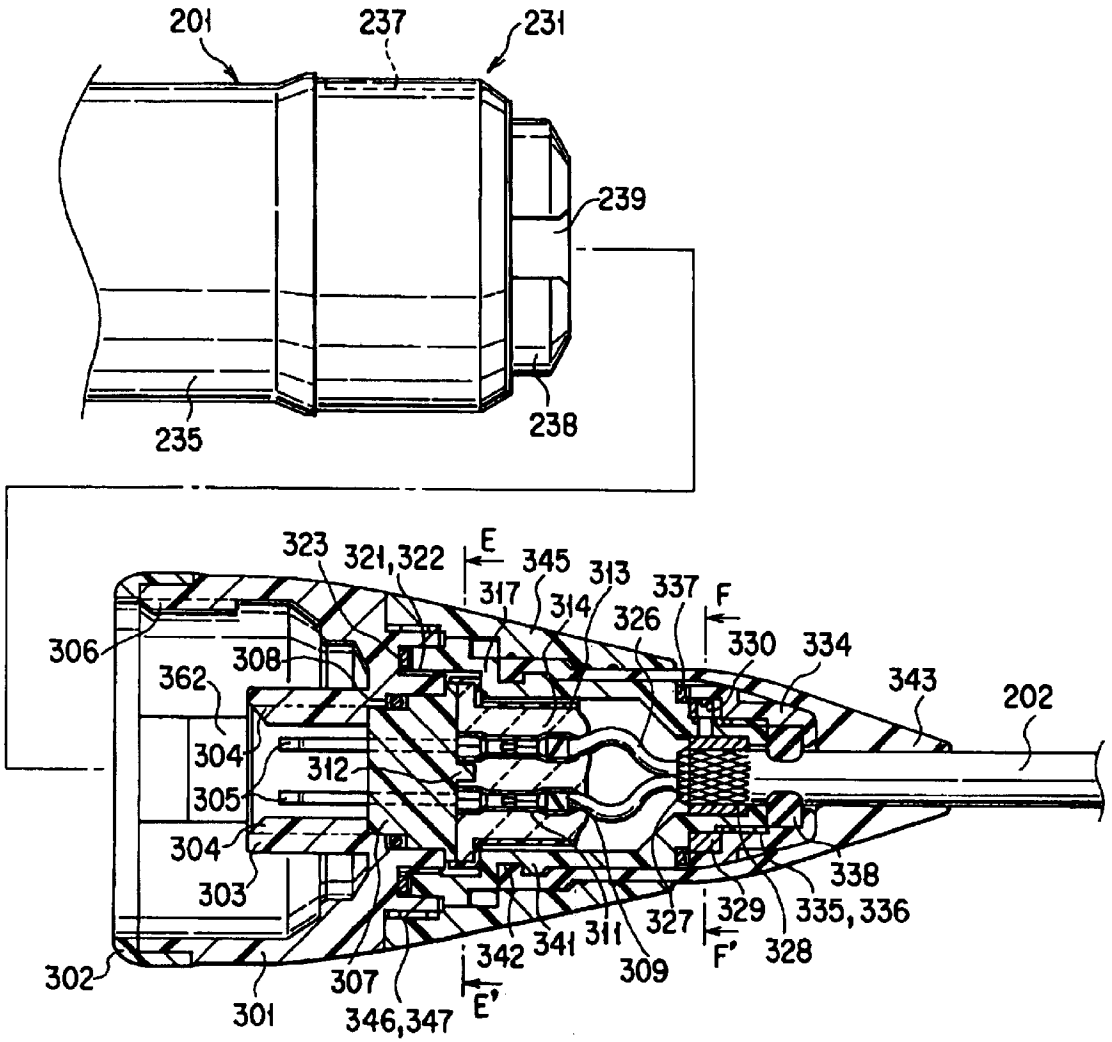
FIG. 7 is a side view of a handpiece plug section of the handpiece and a view in longitudinal cross-section of a handpiece socket of a detachable cable unit in the ultrasonic coagulation incising apparatus according to the first embodiment of the present invention.

FIG. 7 shows the handpiece plug sections 231 of the handpieces 201, 201*a* and handpiece socket 232 of the detachable cable unit 203.

The handpiece socket 232 has a cup-like socket case 301 therein and a first annular wall is formed by the socket case 301. A socket end component part 302 is fixed to the forward end of the socket case 301 by means of an adhesive. A substantially pipe-like inner socket 303 is formed inside the socket case 301. The inner socket 303 forms a second annular wall. The socket case 301 and inner socket 303 are arranged in a concentrical relation with a circumferential groove space defined therebetween. The second annular wall is lower than the first annular wall and located deep in the first annular wall.

A fitting projection 304 is formed in a direction toward the inside of the first annular wall and contacts 305 are located inside the fitting projection 304. As shown in FIG. 7, a position aligning projection 306 is formed on the upper inner surface portion of the socket case 301.

The contacts 305 are incorporated by an insert-molding method into a contact support 307. The contact support 307 is inserted from a cable side into the socket case 301 and, relative to its surface contacting with the socket case 301, an O-ring 308 is provided. The cable side end of the contact 305 projects from the contact support 307 and this projecting end is press-fitted into, and connected to, a compression-bonded terminal 309. A heat shrinking tube 311 is covered on the outside of this connection section.

Figure 8:
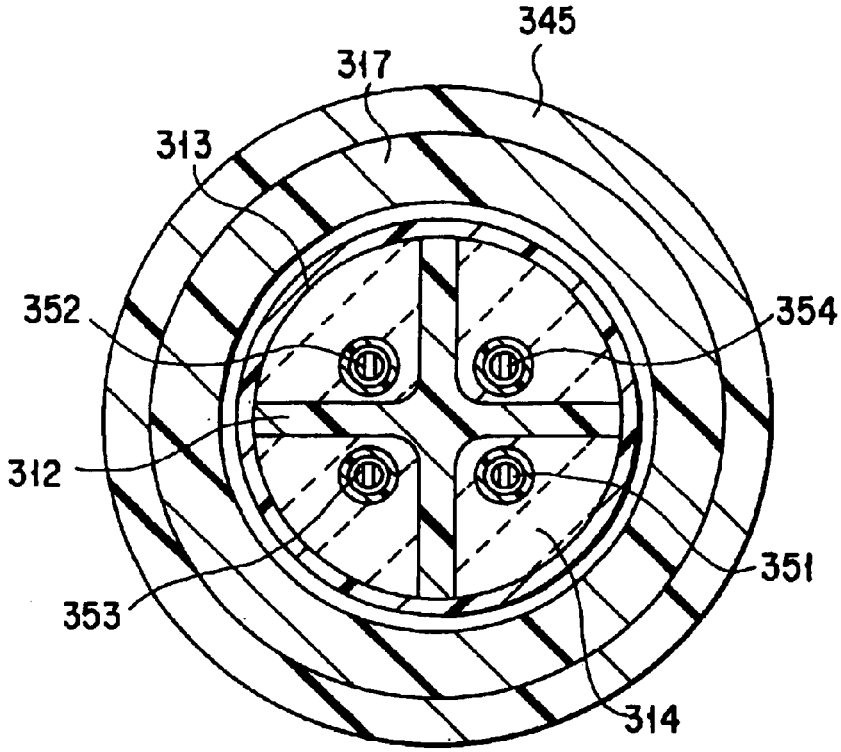
FIG. 8 is a view in transverse cross-section as taken along line E–E' in FIG. 7 showing the handpiece socket in the detachable cable unit.

As shown in FIG. 8, a cross-like partition wall 312 is formed on the cable-side end surface of the contact support 307 to secure a greater creeping distance between the elements. These portions are covered with a filling case 313, made of a transparent resin, in an axial direction. And silicone rubber 314 is filled into that inside gap. As shown in FIG. 7, a main support 317 is fixed to the socket case 301 in such a manner as to retain the filling case 313 and contact support 307 thereby and is so done by connecting a threaded section 321 on the main support 317 to a threaded section 322 in the socket case. Between the contacting surfaces of the socket case 301 and main support 317, a packing 323 is provided to prevent the intrusion of liquid from the exterior.

Figure 9:
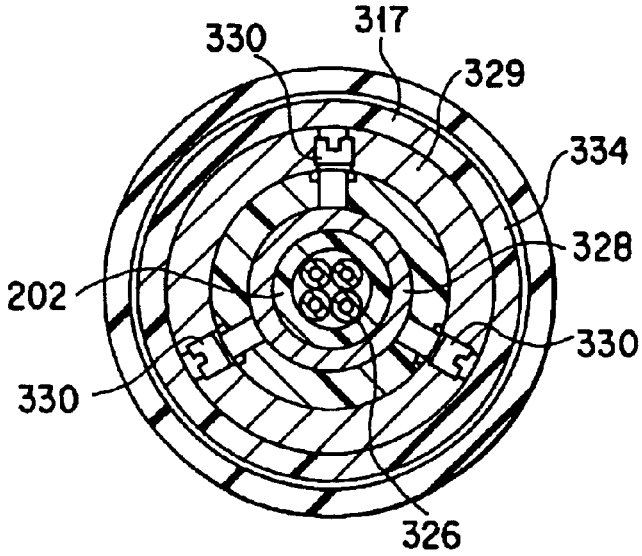
FIG. 9 is a view in transverse cross-section as taken along line F–F' in FIG. 7 showing the handpiece socket in the detachable cable unit.

The lead wire 273 press-fitted in the compression-bonded terminal 309 leaves wire portions with an outer sheath member stripped off the cable 202. A shield 327 provided between the lead wire 273 and the outer sheath member is folded back on the outer surface of the cable 202 and its outside is compression bonded and fixed by a compression bond body 328. As shown in FIG. 9, three fixing screws 330 are threaded from three side directions into a fixing ring 329 with their forward ends abutted against the compression bond body 328. By doing so, the compression bond body 328 is fixedly supported, thereby preventing displacement of the cable in an axial direction and in a rotation direction. In order to hold down the fixing ring 329 in which the main support 317 is fitted, a fold prevention rubber support 334 is fixed to the main support 317 through the threading of the threaded sections 335 and 336.

A packing 337 is provided between the main support 317 and the fold prevention rubber support 334 and a close-contacting rubber 338 is provided between the cable 202 and the fold preventing rubber support 334, thereby preventing the intrusion of liquid through these portions. The fold prevention rubber 343 is mounted by latching an inner circular surface projection 342 to a flange 341 formed on the outer side surface of the main support 317. A socket cover 345 externally covers these and is fixed to the socket case 301 through the threading of the threaded sections 346 and 347.

Although, in FIG. 7, only two contacts are shown, four terminals are provided relative to the contacts 305 and the contacts 305 are so provided as to correspond to four poles. Into the respective terminals, the compression-bonded terminals 309 are press-fitted. These terminals are provided as a handpiece detection terminal 351 and handpiece detection terminal 352 and a drive current terminal 353 and drive current terminal 354. A handpiece detection current and drive current are supplied to the corresponding terminals.

Figure 10:
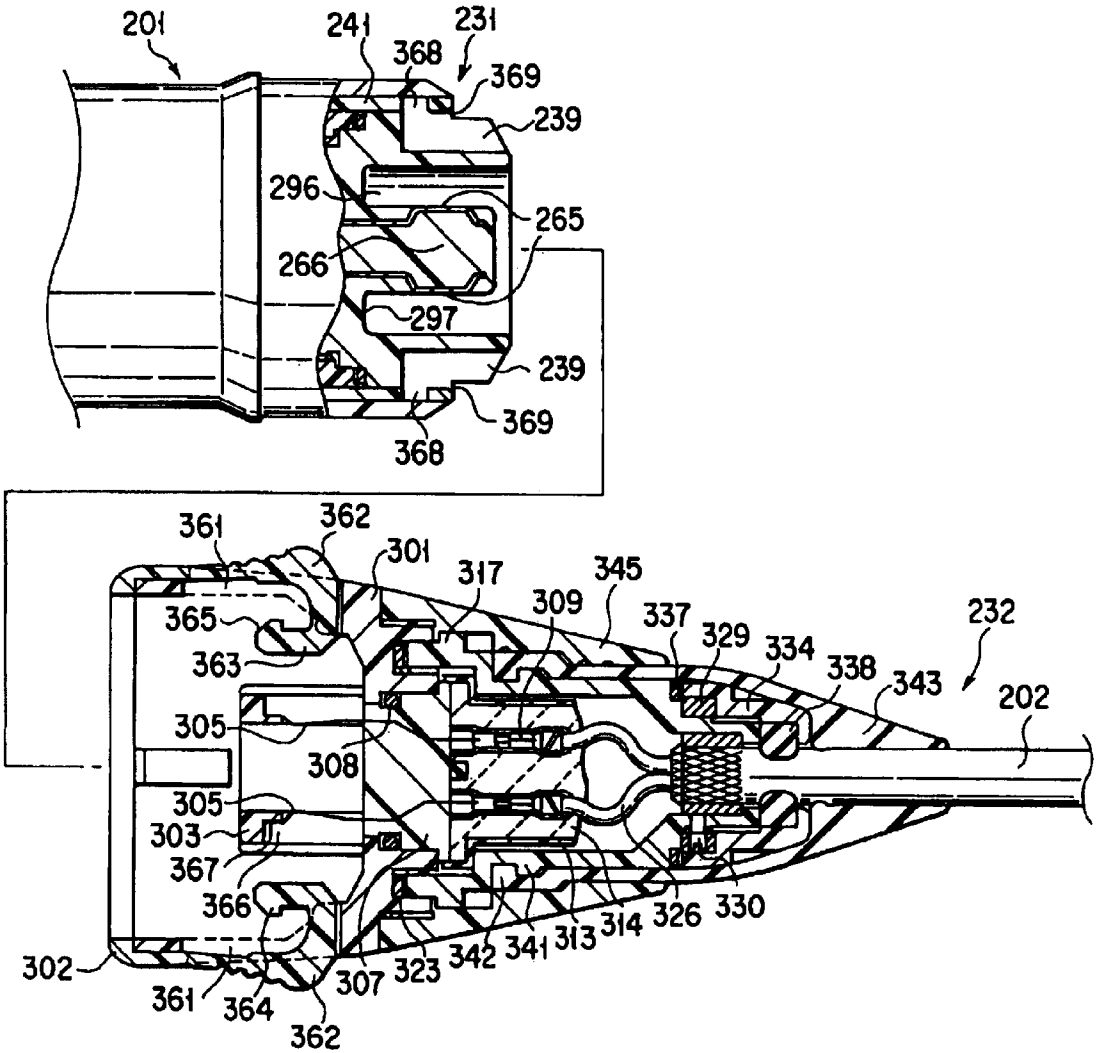
FIG. 10 is a view in longitudinal horizontal cross-section showing the handpiece plug section of the handpiece and the handpiece socket of the detachable cable unit in the ultrasonic coagulation incising apparatus according to the first embodiment of the present invention.

FIG. 10 is a view in longitudinal cross-section as taken in a horizontal plane of the handpiece socket 232. As shown in FIG. 10, an angular hole 361 is formed at the left/right side wall portions of the socket case 301 and a lever 362 extending from a socket end component part 302 is disposed in the hole 361. An inner layer 363 of an inwardly curved configuration is formed as an engaging section inside the lever 362. A lock edge 364 and inclining surface 365 are provided at the end portion of the inner lever 363.

An angular elongated slit 366 is formed at the left and right side wall portions of the inner socket 303. In the slit 366, a corresponding contact 305 extending from a contact support 307 is so arranged as to be elastically urged against an abutting surface 367 formed in the slit 366. The slit 366 and contact 305 are arranged at four places in a symmetrical fashion. The slit 366 is provided parallel to the longitudinal axis of the socket. One end of the contact 305 is fixedly supported on the contact support 307 and the other end portion of the contact 305 can be elastically deformed on its partway.

As shown in FIG. 10 where the handpiece 201 is cut along a horizontal longitudinal cross-section, a lock hole 368 is formed as a lock section in an inner case 241 at a position of the handpiece plug section 231. An inclining surface 369 is formed near an opening of a lock guide 239.

Now, the operation of the ultrasonic coagulation incising apparatus will be explained below. In use, the generator plug 233 of the detachable cable unit 203 is connected to the power supply generator 234. The hook probe unit 205 and scissors probe unit 206 are previously attached to the handpiece 201 and, further, the trocar unit 207 is attached to the handpiece 201*a*.

Figure 11:
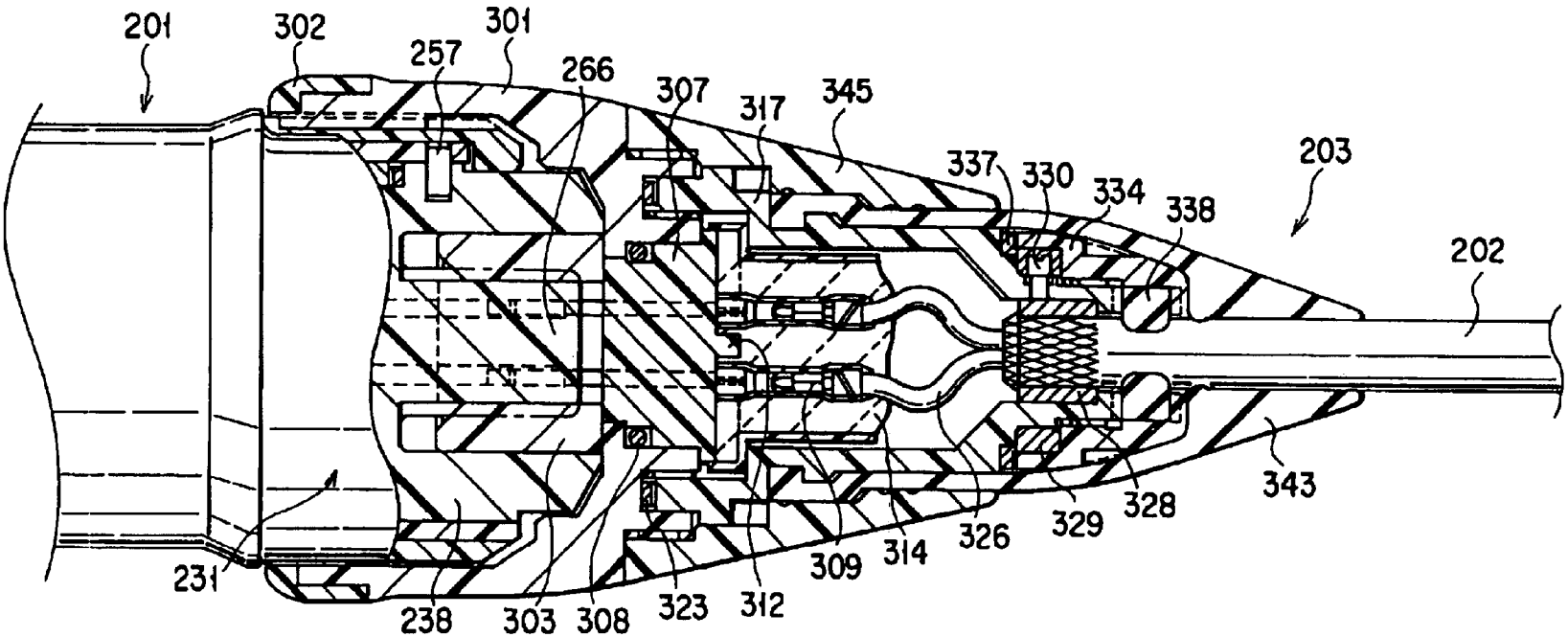
FIG. 11 is a view in longitudinal cross-section showing a connected state of the handpiece plug section of the handpiece and handpiece socket of the detachable cable unit in the ultrasonic coagulation incising apparatus according to the first embodiment of the present invention.
Figure 12:
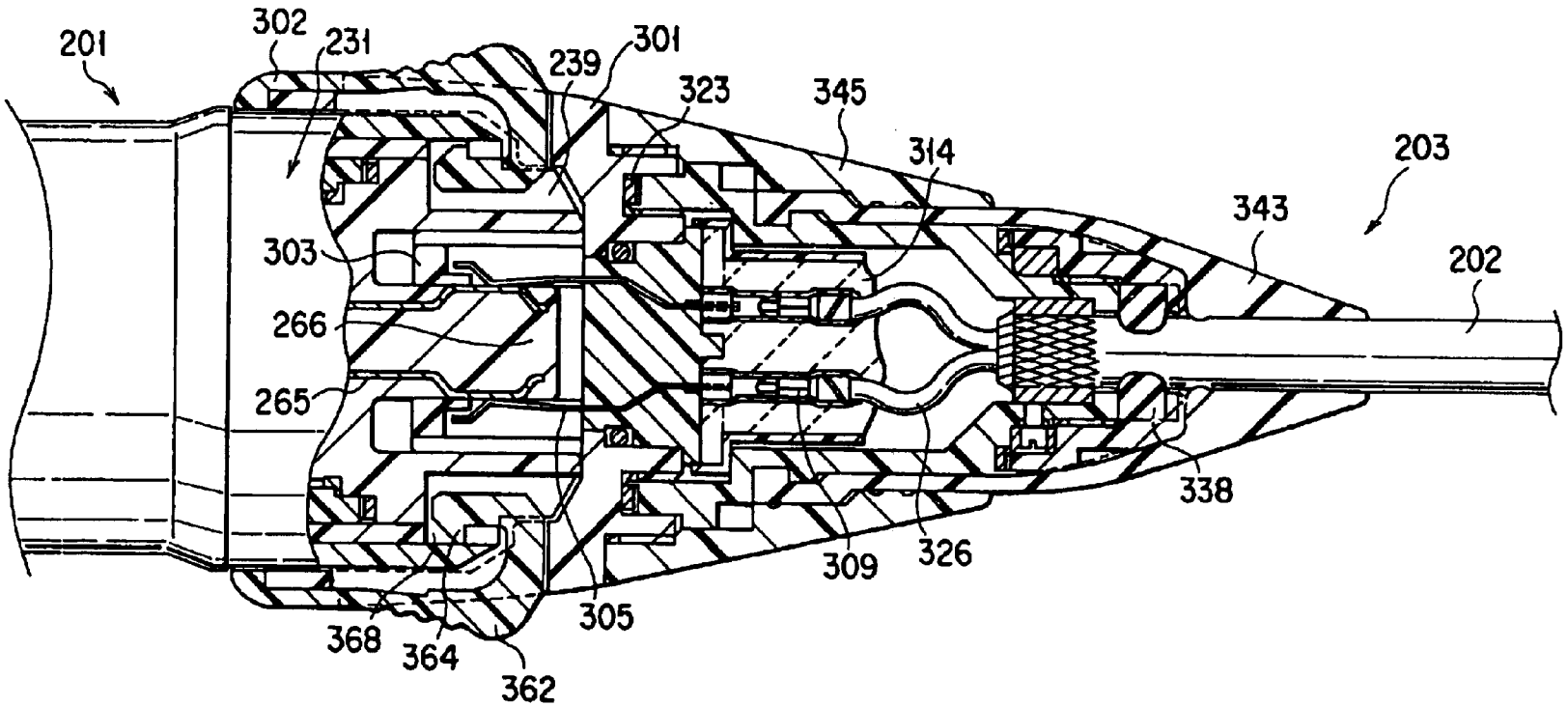
FIG. 12 is a view in longitudinal horizontal cross-section showing a connected state of the handpiece plug section of the handpiece and handpiece socket of the detachable cable unit in the ultrasonic coagulation incising apparatus according to the first embodiment of the present invention.

First, when the trocar unit 207 is used, the handpiece socket 232 of the detachable cable unit 203 is fitted over the handpiece plug section 231 of the handpiece 201*a* to which the trocar unit 207 has been attached. At this time, an assembly operation is performed while the position aligning projection 306 is guided along the position aligning groove 237. When the handpiece socket 232 of the detachable cable unit 203 is attached to the handpiece plug section 231, the inclining surface 365 of the inner lever 363 of the lever 362 is guided along the lock guide 239 and clear of the inclining surface 369, so that the lock edge 364 is fitted into the lock hole 368. Since the contact 305 is urged toward an inward direction, the contact 305 is set in positive contact with the contact 265 as shown in FIGS. 11 and 12, thus securing their electrical connection.

On the other hand, a handpiece detection current from the generator is immediately supplied through the generator plug 233, cable 202, lead wire 273 and compression-bonded terminal 309 to the handpiece detection terminal 351 and handpiece detection terminal 352 and through the contact 265 contacting the contact 305 to the handpiece detection terminal 275 and handpiece detection terminal 276. Since the resistor 278 is connected to the forward ends of the handpiece detection terminal 275 and handpiece detection terminal 276, the resistance values are detected and setting is made on the generator 234 side to allow a resonant frequency and electric current suitable for the handpiece 201 to be supplied as a drive current.

In the structure thus arranged, the handpiece socket 232 is externally fitted over the handpiece plug section 231 and a strength increased when an external force was exerted on the handpiece 201 and handpiece socket 232. Since the fitting projection 304 is fitted in the fitting slit 295 for guiding, an optimal positional relation is ensured for electrical connection. The electrical connection capability is therefore never lowered, even if a torque moment is exerted on it.

Then, when a forward end of the trocar unit 207 attached to the handpiece 201*a* is set in contact with the abdominal wall of the patient and a foot switch, not shown, is depressed, a drive current from the generator 234 is conducted through the generator plug 233 and cable 202 and then through the lead wire 273 to the compression-bonded terminal 309 and then through the contact 305 constituting an inner contact surface of the inner socket 305 constituting an inner contact surface of the inner socket 303 and the contact 265 to the handpiece 201*a*. The drive current is supplied from the drive current feeding terminals 267, 268 through the electroconductive member 269, terminal 271 to the lead wire 273 and it is converted to an ultrasonic vibration by means of the bolted Langevin type transducer 242. At that time, the ultrasonic vibration acts on the abdominal wall at the forward end of the trocar unit 207 to allow the abdominal wall to be pierced.

After this, the outer sheath tube 226 is retained and it is used to allow a treating tool to be inserted for a surgical operation under an endoscope. In a similar manner, another new outer sheath tube 226 is also set in the pierced abdominal wall. By doing so, a requisite number of outer sheath tubes are set in the pierced abdominal wall and retained there.

When the handpiece socket 232 is to be removed from the handpiece 201*a*, the lever 362 is depressed and, by doing so, the handpiece socket 232 is pulled out of the handpiece plug section 231. Then the lock edge 364 is unlocked from the lock hole 368 and the handpiece socket 232 can be readily removed out of the handpiece 201*a*.

This removed handpiece socket 232 is attached to the handpiece 201 to which the hook probe unit 205 or scissors probe unit 206 has been attached. Then, the resistance of the resistor in the handpiece 201 is detected and the generator supplies a drive current so as to set a resonant frequency and current value suitable for the handpiece 201.

If the foot switch is depressed in a proper timing, the drive current from the generator 234 is supplied to the handpiece 201 and it is converted to an ultrasonic vibration, so that a treating operation can be performed at the forward end of the respective probe.

When the hook probe unit 205 and scissors probe unit 206 are used in an exchangeable way, a handpiece 201 with one of these probe units is removed from the handpiece socket 232 by depressing the lever 362 and another handpiece 201 with the other probe unit is attached to the handpiece socket 232 and this new handpiece is used.

FIG. 6 shows the state in which the fitting space 296 at the handpiece plug section 231 of the handpiece (201, 201*a*) is washed. Washing is made by moving a brush section 299 of a cleaning brush 298 into and out of the fitting space 296 of the handpiece plug section 231. The brush section 299 can reach the inner corners of the fitting space 296. Further, the fitting space 296 has a gap of about 2 to 4 mm and the operator's finger, etc., cannot be inserted into the gap. However, the brush section 299 of the cleaning brush 298 can be inserted into the space 296, so that it is possible to clean the fitting space 296.

According to this structure, the connector can be fitted into the fitting space and, since the cleaning brush can be inserted into this narrow space, the cleanability of electric contacts in the connector is improved. As a result, it is possible to prevent a lowering in electrical conduction capability. Needless to say, the inside of the cable-side socket is wider than the fitting space of the handpiece and there arises no problem from the standpoint of its washing. In case a liquid such as water enters the connector, the contacts are located a given distance away from the inner bottom of the connector and, even if a little amount of liquid is accumulated there, there arises no shortening between the contacts. If a somewhat greater amount of liquid is pooled inside the connector, the handpiece (201, 201*a*) is tilted toward a lateral side direction and, by doing so, the liquid is flowed out of the connector. Therefore, there arises no "shorting" problem. In the handpiece socket 232 on the detachable cable unit 203 side, even if a liquid enters the inside of the contact, the slit 366 is provided on the rear side of the contact and serves as a liquid drain, so that it is quickly drained. Therefore, no shorting occurs between the contacts.

According to the present embodiment, needless to say, the desired probes can be quickly exchanged without the need of connecting and disconnecting the probes through their threaded sections.

According to the present invention, as set out above, there is provided a connector for medical instruments capable of detachably connecting the plug for the medical instrument to the socket for power supply, the connector ensuring an electrical conduction capability by preventing electric contacts in the connector from being soiled and preventing an operator's finger from unduly touching the electric contacts.

Figure 13:
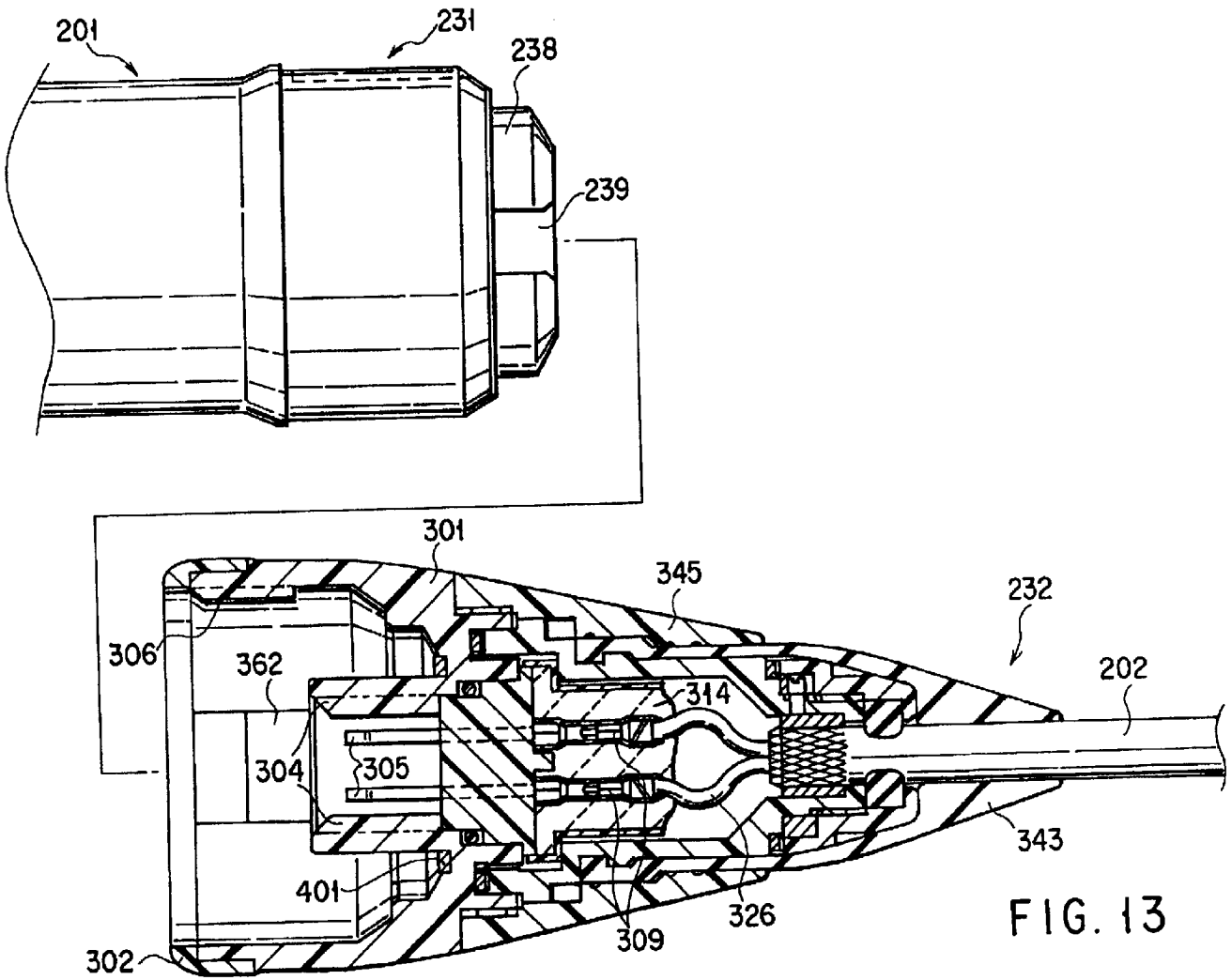
FIG. 13 is a view in longitudinal cross-section showing a handpiece socket of a detachable cable unit relative to a handpiece plug section of a handpiece in an ultrasonic coagulation incising apparatus according to a second embodiment of the present invention.
Figure 14:
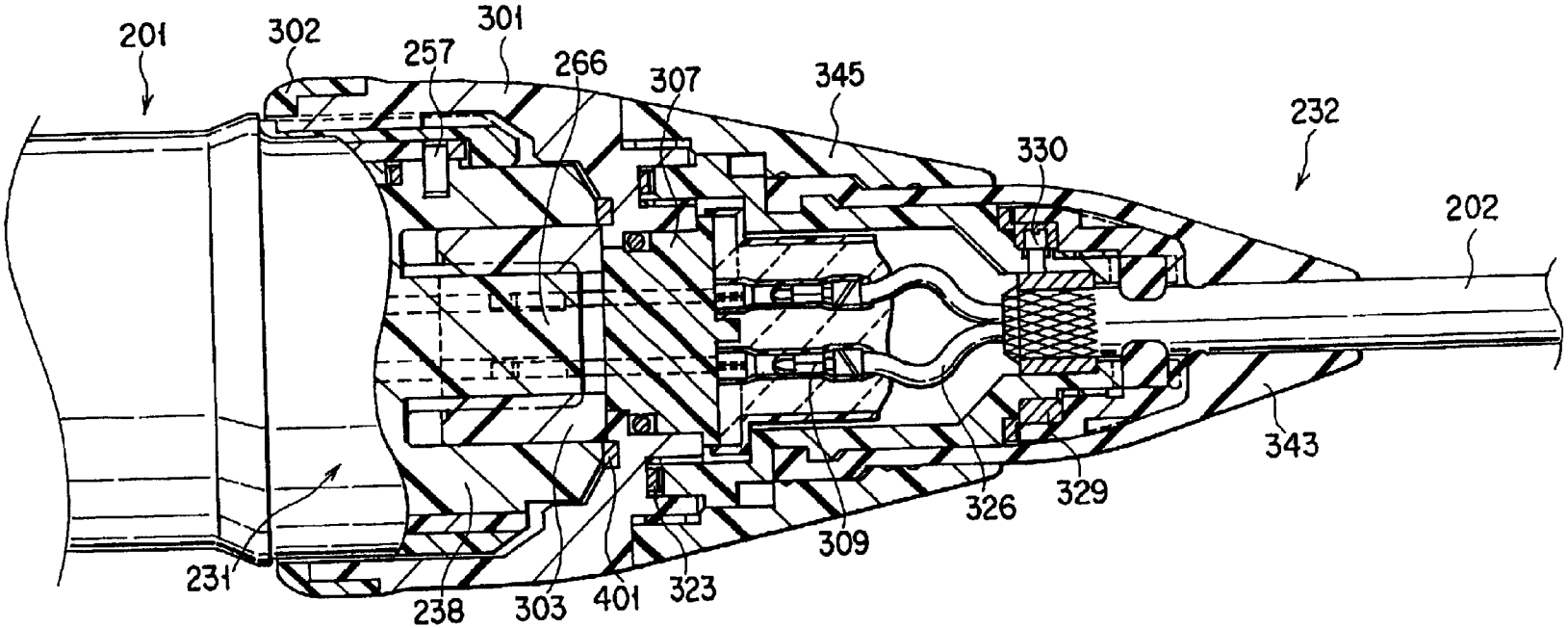
FIG. 14 is a view in longitudinal cross-section showing a connected state of the handpiece plug section of the handpiece and handpiece socket of the detachable cable unit in the ultrasonic coagulation incising apparatus according to the second embodiment of the present invention.

An ultrasonic coagulation incising apparatus according to a second embodiment of the present invention will be described below by referring to FIGS. 13 and 14. The second embodiment constitutes a variant of the first embodiment and an explanation will be made below mainly about its different aspect.

A packing 401 is provided at that surface of a socket case 301 on the detachable cable unit 203 side against which a connector shell 238 is abutted. As shown in FIG. 14, when a handpiece socket 232 is attached to a handpiece plug section 231, the end face of the connector shell 238 is abutted against the packing 401. In this attached state, even if the associated parts are exposed to a liquid, the liquid cannot enter the inside of the connector, so that it is possible to prevent a shorting between contacts. According to the second embodiment of the present invention it is possible to obtain the same advantages as those of the first embodiment.

Figure 15:
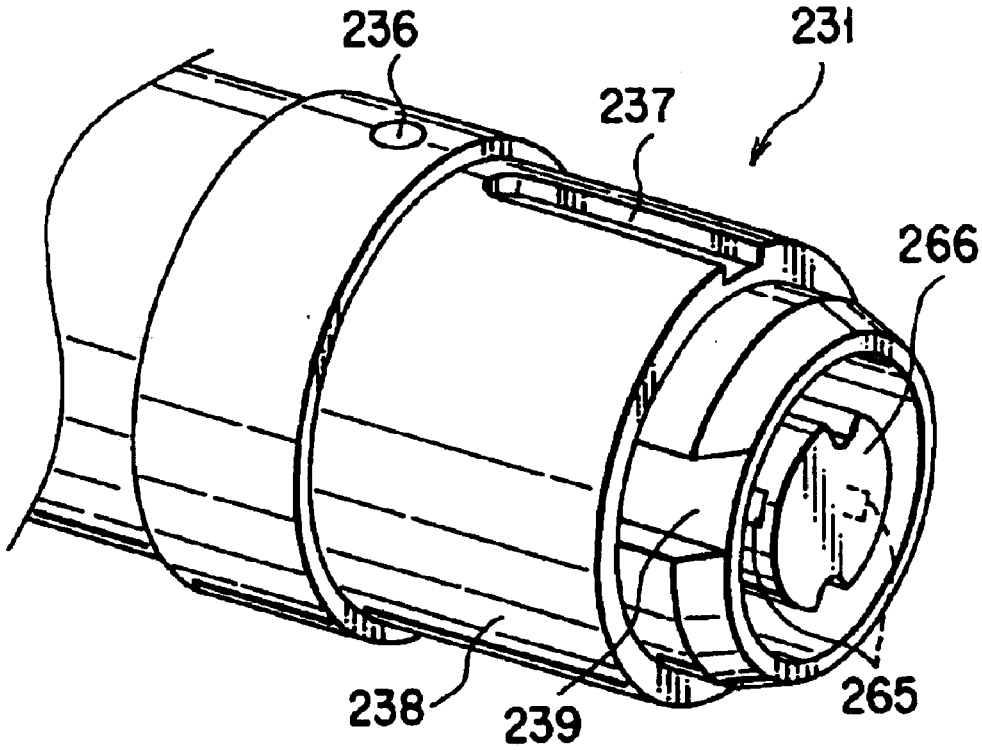
FIG. 15 is a perspective view showing a handpiece plug section of a handpiece in a ultrasonic coagulation incising apparatus according to a third embodiment of the present invention.

An ultrasonic coagulation incising apparatus according to a third embodiment of the present invention will be described below by referring to FIG. 15. The third embodiment constitutes a variant of the first embodiment of the present invention and an explanation will be made below mainly about its different aspect.

In this ultrasonic treating instrument, a handpiece is comprised of one kind of system and it is not necessary to provide a detection resistor. As shown in FIG. 15, therefore, it is only necessary that a contact 265 be arranged in two places.

The advantages of this variant are the same as those of the first embodiment of the present invention except that it is not possible to use a different handpiece.

Although the above-mentioned first to third embodiments have been explained as being preferred embodiments of the present invention, the present invention is not restricted to the first to third embodiments. That is, the present invention relates to a connector for medical instruments including a medical instrument unit having a plug and a medical instrument unit having a socket engaging the plug. The present connector can be applied to all those medical instrument units which, when the plug and socket engage each other, are rendered active based on an electric power fed from a power supply. For example, the present invention can be used for a plug/socket system involving an electric surgical knife and heating surgical knife.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A connector for medical instruments adapted to be rendered active upon receipt of electric power from a power supply to allow a treating operation to be performed on a subject wherein the connector is removably attachable to a socket having a first electrode to allow the electric power to be supplied to the medical instrument and wherein the connector comprises:

a projection protruding in a moving direction in which the medical instrument is connected to the socket electrically connected to the power supply;

a second electrode electrically connectable to the first electrode wherein an exposed contact portion of the second electrode is formed as an elongated portion that extends along the moving direction, the exposed contact portion being located peripherally around the projection; and a connector shell extending in the moving direction, about and spaced away from the projection in a manner that forms a groove therebetween.

2. The connector for medical instruments, according to claim 1, wherein each of the first and second electrodes comprises a plurality of electrode elements, and when the socket and connector are connected to each other, the electrode elements of the first and second electrodes are electrically connected together in mutually corresponding relation.

3. The connector for medical instruments, according to claim 2, wherein the plurality of electrode elements of the second electrode are provided on a peripheral surface the projections at least a portion of the electrode elements of the second electrode being exposed on the peripheral surface of the projection as to form the exposed contact portion.

4. The connector for medical instruments, according to claim 3, wherein a height of the connector shell from a bottom surface of groove is higher than that of the projection from the bottom surface of the groove.

5. The connector for medical instruments according to claim 1, further comprising:

an element configured to detect the type of medical instruments; and a third electrode electrically connected to the element.

6. The connector for medical instruments, according to claim 5, wherein the element has an electric resistor.

7. The connector for medical instruments, according to claim 1, further comprising:

an element configured to detect the type of medical instrument and provided so as to enable electric power which is suitable for the medical instrument to be supplied from the power supply.

8. The connector for medical instruments, according to claim 7, wherein the element has an electric resistor.

9. A connector for medical instruments, comprising:

a socket removably attachable to medical instruments and adapted to be rendered active upon receipt of electric power from a power supply to allow the electric power to be supplied to the medical instrument; and a plug provided on the medical instrument and connected to the socket to allow the electric power which is fed from the power supply to be supplied to the medical instrument, wherein the plug includes a projection provided at a central area;

a second electrode provided on a peripheral surface of the projection and having at least a portion exposed on the peripheral surface of the projection and electrically connectable to the first electrode to allow the medical instrument to be rendered active; and a connector shell provided away from the projection, the connector shell and the projection being spaced apart from each other as to form a groove therebetween.

10. The connector for medical instruments, according to claim 9, wherein the first electrode comprises a plurality of electrode elements, the second electrode comprises electrode elements corresponding in number to those of the first electrode, and when the socket and plug engage each other, the elements of the first and second electrodes are electrically connected together in a mutually corresponding relation.

11. The connector for medical instruments, according to claim 9, wherein a height of the connector shell from a bottom surface of the groove is higher than that of the projection from the bottom of the groove.

12. The connector for medical instruments, according to claim 9, wherein the connector shell includes a first annular wall provided outside the projection as to surround the second electrode and the projection is inside the first annular wall, and wherein the socket further comprises a second annular wall engageable with the projection and formed with the first electrode.

13. The connector for medical instruments, according to claim 12, wherein the socket further comprises a third annular wall connectable with the first annular wall and higher than the second annular wall.

14. The connector for medical instruments, according to claim 12, wherein, when the socket is connected to the plug, the second annular wall engages the projection and the first electrode is electrically connected to the second electrode.

15. The connector for medical instruments, according to claim 9, further comprising:

an element provided in the plug to detect the kinds of medical instruments;

a third electrode provided in the plug and electrically connected to the element; and a fourth electrode provided in the socket in such a way as to be electrically connectable with the third electrode.

16. The connector for medical instruments, according to claim 15, wherein the element is comprised of an electric resistor.

17. The connector for medical instruments, according to claim 9, further comprising: an element configured to detect the type of medical instrument and provided in the plug to enable an electric power which is suitable for the medical instrument to be fed from the power supply.

18. The connector for medical instruments, according to claim 17, wherein the element is comprised of an electric resistor.

19. The connector for medical instruments, according to claim 12, wherein the second electrode is comprised of an elongated plate-like electrode extending in a moving direction in which the plug is connected to the socket.

20. The connector for medical instruments, according to claim 9, wherein the first electrode is comprised of an elongated, elastic plate-like electrode extending in a moving direction in which the plug is connected to the socket.

21. The connector for medical instruments, according to claim 1, further comprising: a guide provided in the plug to restrict a moving direction of the socket when the socket is connected to the plug.

22. The connector for medical instruments, according to claim 9, further comprising: a lock section provided in the plug and a lever provided in the socket to provide a latching engagement, wherein the lever includes a latching section for allowing an automatic latching engagement to be made with the lock section when the plug is attached to the socket and an operation section for allowing the latched lever to be disengaged.

23. The connector for medical instruments, according to claim 9, wherein the socket further comprises one cable for feeding an electric power from a power supply to a medical instrument to be used and the socket is connected to the cable and exchangeably connectable to a plurality of the same plug type of medical instruments.

24. A medical instrument, comprising:

an ultrasonic handpiece, the ultrasonic handpiece having a transducer for converting a drive current to ultrasonic vibration, and a plug removably attached to a socket connected to a cable for feeding a drive current from a generator to the transducer, wherein the plug comprises:

a projection formed at a central area;

a connector shell formed outside the projection so as to be spaced apart a distance from a peripheral area of the projection; and an electric contact formed on the peripheral area of the projection at a position surrounded by the connector shell.

25. The medical instrument, according to claim 24, wherein the electric contact is provided on the peripheral surface of the projection and arranged parallel to a longitudinal axis of the handpiece.

26. The medical instrument, according to claim 24, wherein the electric contact is arranged at a position spaced apart by more than a width of the electric contact from a deep bottom of a groove defined between the connector shell and the projection and is exposed on the projection.

27. The medical instrument, according to claim 25, wherein the width of the groove defined between the projection and the connector shell is greater than the width of the electric contact but smaller than the diameter of the projection.

28. The medical instrument, according to claim 27, wherein the plug further comprises a fitting groove formed parallel to the longitudinal axis of the handpiece at a position between electric contacts arranged on the outer peripheral surface of the projection.

29. The medical instrument, according to claim 26, wherein the electric contact is arranged at a position spaced apart by more than the width of the electric contact, on a bottom side of the groove, from the forward end surface of the projection.

30. A medical instrument, comprising:

an ultrasonic handpiece having a plug and a transducer for converting a drive current to an ultrasonic vibration;

a socket connected to a cable for feeding the drive current from a generator to the transducer, wherein the plug is removably attached to the socket;

a first electric contact provided in the socket;

a second electric contact provided in the plug and electrically connected to the first electric contact, a projection provided in the plug and protruding in a moving direction in which the medical instrument is connected to the socket; and a connector shell provided in the plug and protruding in the moving direction wherein the connector shell is provided outside the second electric contact and leaves a predetermined distance relative to the projection as to form a groove therebetween.

31. The medical instrument, according to claim 30, wherein the plug further comprises an adapter provided on the outer periphery of the connector shell to allow the socket to be set in a latching engaged state.

32. A medical instrument, comprising:

an ultrasonic handpiece having a transducer for converting a drive current to an ultrasonic vibration;

a plug provided in the ultrasonic handpiece and having a first electric contact;

a handpiece socket removably attached to the plug, a cable unit for supplying a drive current from a generator to the transducer; and a socket provided on the handpiece socket and having an inner space for allowing a connector projection of a plug section of the ultrasonic handpiece to be fitted therein, wherein the socket includes a slit extending from an outer surface thereof into the inner space and a second electric contact provided in the slit to be set in contact with the first electric contact and the plug includes a projection protruding in a moving direction in which the plug is connected to the socket and the first electric contact is provided on a peripheral surface of the plug and the plug and its first electric contact are surrounded by a connector shell of the plug.

33. The medical instrument, according to claim 32, wherein one end of the second electric contact is fixedly supported in the socket and the other end portion thereof is elastically deformable.

34. The medical instrument, according to claim 33, wherein the slit is formed parallel to a longitudinal axis of the socket.

35. The medical instrument, according to claim 34, wherein the socket has a first annular wall and second annular wall, the second annular wall being situated inside the first annular wall and the slit being formed in the second annular wall.

36. The medical instrument, according to claim 35, wherein the second annular wall is lower than the first annular wall.

37. The medical instrument, according to claim 35, wherein the socket further comprises a circular packing located at a bottom between the first annular wall and the second annular wall to maintain a water-tight seal between a casing and the socket.

* * * * *